US005655755A

United States Patent [19]

Brandt

[11] Patent Number: 5,655,755

[45] Date of Patent: Aug. 12, 1997

[54] STANCHION RAIL SUPPORT AND STANCHION

[76] Inventor: George Donald Brandt, 326 Freres Ave., Racine, Wis. 53405

[21] Appl. No.: 683,768

[22] Filed: Jul. 17, 1996

[51] Int. Cl.[6] ..... E04F 11/18

[52] U.S. Cl. ..... 256/65; 256/59; 256/DIG. 5

[58] Field of Search ..... 256/DIG. 5, 65, 256/59

[56] References Cited

U.S. PATENT DOCUMENTS

| | | | |
|---|---|---|---|
| 3,740,084 | 6/1973 | Tellberg . | |
| 3,960,367 | 6/1976 | Rogers | 256/65 X |
| 3,995,833 | 12/1976 | McLaughlin et al. . | |
| 4,236,698 | 12/1980 | Compte . | |
| 4,577,449 | 3/1986 | Celli . | |
| 4,666,131 | 5/1987 | Kettelkamp, Sr. et al. . | |
| 4,752,060 | 6/1988 | McCluskey et al. . | |
| 4,923,176 | 5/1990 | Heinz | 256/21 X |
| 5,269,394 | 12/1993 | Haroldson, Sr. . | |
| 5,314,167 | 5/1994 | Holloman . | |
| 5,452,880 | 9/1995 | Bailey | 256/65 X |
| 5,547,169 | 8/1996 | Russell | 256/65 X |
| 5,551,669 | 9/1996 | Reinklou | 256/65 |

*Primary Examiner*—Anthony Knight
*Attorney, Agent, or Firm*—DeWitt Ross & Stevens SC

[57] ABSTRACT

A stanchion for removable installation of guard rails for use in construction, crowd control, and like situations wherein removable barriers are required. The stanchion includes paired engageable collars which may be rotated and axially slid on the stanchion post, and brackets or other devices for attaching rails to the collars. To orient rails in a desired direction, the collars are disengaged, rotated so the brackets are directed as desired, and then reengaged to lock the collars in the desired orientation.

20 Claims, 3 Drawing Sheets

FIG. 3
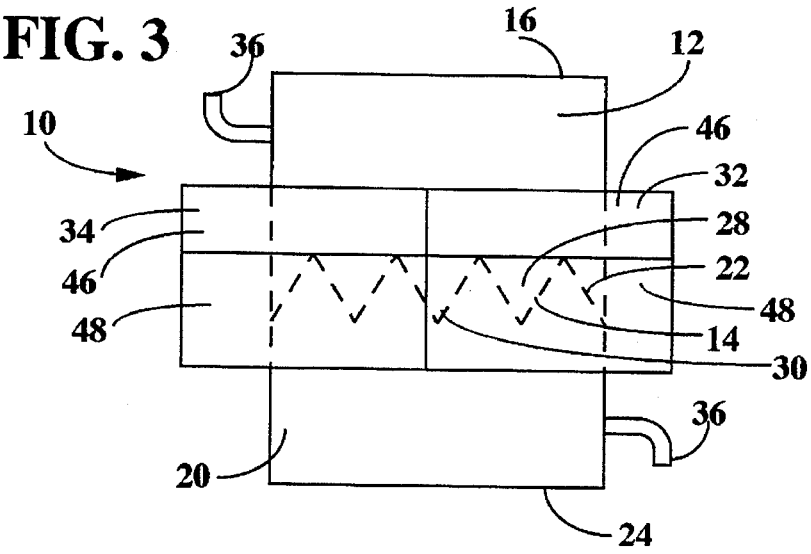
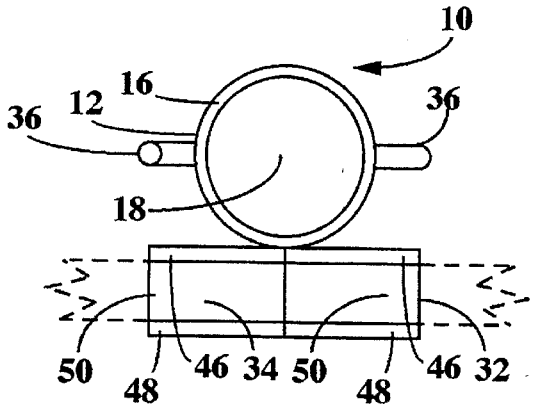
FIG. 4
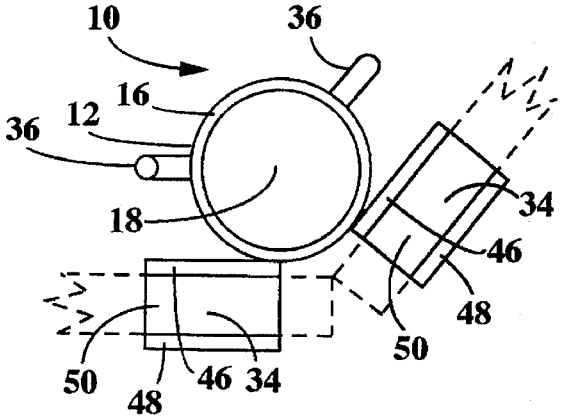
FIG. 5
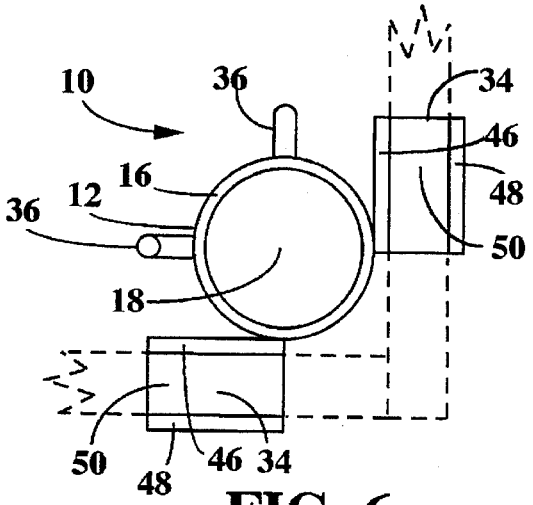
FIG. 6
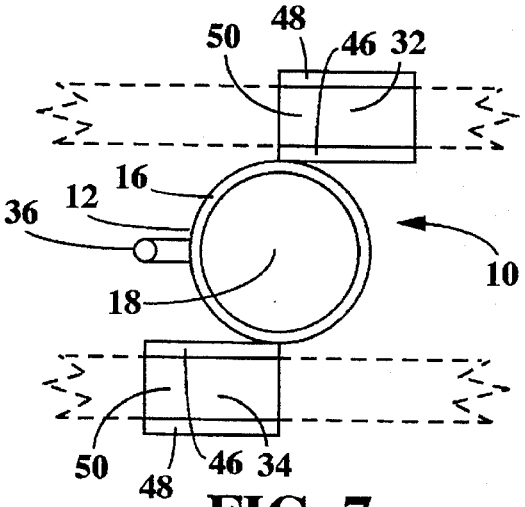
FIG. 7

STANCHION RAIL SUPPORT AND STANCHION

FIELD OF THE INVENTION

The present invention relates to stanchion rail supports for attachment to a stanchion post to allow the creation of a guard rail when rails are attached to the stanchion rail supports. The present invention is further directed to a stanchion incorporating such stanchion rail supports.

DESCRIPTION OF THE PRIOR ART

Guard rails, temporary fences, and the like are used around work areas to protect workers from falls or dangerous areas. In many instances such guard rails are temporary in nature, and are intended to be used only during periods of construction. Quite frequently, these guard rails are improvised and are made by fastening together appropriate lengths of timber. Such guide rails may not conform to government safety regulations, for example, those rules promulgated under the United States Occupational Health and Safety Act. Additionally, these guide rails tend to be time-consuming to construct and wasteful of timber. Owing to the cost of timber, the guard rails are frequently disassembled and reused, but each successive cycle of disassembly and reassembly tends to weaken the rails owing to an increase in nail holes and the like. This makes them more dangerous to use upon subsequent reassembly.

Several guide rail stanchions and/or stanchion rail supports for supporting rails on stanchions have been proposed to solve the aforementioned problems. These apparata generally provide a vertical stanchion to which horizontal timber guide rails or guide rails of other materials may be attached. Exemplary apparata are found in U.S. Pat. No. 3,740,084 to Tellberg; U.S. Pat. No. 3,995,833 to McLaughlin et al.; U.S. Pat. No. 4,236,698 to Compte; U.S. Pat. No. 4,577,449 to Celli; U.S. Pat. No. 4,666,131 to Kettelkamp, Sr. et al.; U.S. Pat. No. 5,269,394 to Haroldson, Sr.; U.S. Pat. No. 4,752,060 to McCluskey et al.; and U.S. Pat. No. 5,314,167 to Holloman. While these apparata do in some cases help to alleviate the problems of improvised guide rails, they still tend to suffer from several problems.

First, many of the prior art apparata are not very versatile in that they will only accommodate particular types of guide rails. For example, U.S. Pat. No. 3,740,084 to Tellberg illustrates stanchion rail supports which only easily accommodate guide rails having rectangular cross-sections. Lengths of cylindrical pipe, ropes, straps, or other materials with flexible or non-rectangular cross-sections are generally unsuitable for use as guide rails with these apparata.

Second, many of the prior art apparata are not very versatile in that they will only accommodate guide rails with particular lengths. As an example, U.S. Pat. No. 5,314,167 to Holloman appears to illustrate in FIGS. 1 and 3 an exemplary apparatus wherein all guide rails supported between two adjacent stanchions must have the same or very similar lengths. However, the timber available for use as guide rails at a site is frequently not of uniform size, and it is wasteful and time-consuming to cut it all to the same size. Specialized guide rail systems such as that illustrated by U.S. Pat. No. 4,236,698 to Compte are similarly inflexible in that they require specialized rails, and users are limited to the particular guide rail lengths provided by the specialized rails.

Third, the prior art apparata still generally lead to the creation of guard rails which are rather wobbly and flimsy, and these can cause anxiety or outright danger when they are installed and used at greater heights. In particular, they often fail to restrain installed guard rails in one or more dimensions or degrees of freedom. For example, many of the aforementioned apparata do not restrain guard rails from rotational motion about their stanchions (see, e.g., U.S. Pat. No. 5,269,394 to Haroldson, Sr., and the embodiment of FIG. 6 of U.S. Pat. No. 4,752,060 to McCluskey et al.). Others utilize guide rail supports which can generally only accommodate a single guide rail at a time, thereby making it difficult to interconnect separate segments of railing to provide a sturdier guide rail (see, e.g., FIG. 1 of U.S. Pat. No. 4,666,131 to Kettelkamp, Sr. et at., which illustrates discrete segments of railing forming an overall guard rail system). Ideally, a guard rail support should allow more than one railing to fit therein, or should accommodate overlapping lengths of railing, so that two railings can be simultaneously inserted to create a sturdy and continuous extended rail.

Fourth, many of the prior art apparata are not very versatile in that they only allow installation of guide rails at a small number of preset orientations. For example, many only allow installation of guide rails along a straight line (e.g., U.S. Pat. No. 3,995,833 to McLaughlin et al., and U.S. Pat. No. 5,314,167 to Holloman), or at 90 degrees about the stanchions (as with U.S. Pat. No. 4,577,449 to Celli, and particular embodiments illustrated in U.S. Pat. No. 5,269,394 to Haroldson, Sr.). These are difficult to use when guide rails are to be installed about a curved ledge or other structure. Additionally, where the guide rail supports are dedicated to either straight or 90 degree square corner applications, users must be sure that a number of stanchions using each type of dedicated support are available for use at a construction site or it may not be possible to complete the railing.

SUMMARY OF THE INVENTION

The present invention, which is intended to address the aforementioned problems of the prior art apparata, is directed to a stanchion rail support for supporting guide rails upon stanchion posts, and also to stanchions utilizing such stanchion rail supports. In the following Summary and the remainder of this specification, it should be understood that the term "stanchion" is primarily used to refer to vertically upright members used to support one or more horizontal guard rails. However, the term may be understood as encompassing members at non-vertical orientations which are used to support one or more beams or guard rails at non-horizontal orientations.

While the invention is defined by the claims following the Detailed Description of the Invention set out below, the following overview of the invention is presented to provide an aid in understanding these claims.

The present invention is directed to a stanchion rail support including a rail holding means for supporting at least one rail on the collar, a first collar and a second collar, each collar having an internal aperture sized to receive a stanchion post therein. The collars include collar engagement means for removably engaging the collars together when they are brought into abutment on the stanchion post. These collar engagement means are preferably provided by at least one protrusion adjacent the internal aperture on the first collar, and at least one detent adjacent the internal aperture of the second collar. Each detent is sized to receive one protrusion therein when the second collar is brought into abutment with the first collar. As a result, the collars may be fit over a stanchion and rotated so that their rail holding means are oriented in a desired direction, and the protrusion (s) on the first collar may then be fit into the detent(s) on the second collar so that the collars may be locked in place. Because the collar engagement means (i.e., the protrusions and detents) lock the collars in place and prevent their relative rotation, the collars provide for the installation of guide rails which are much more rigidly supported on their stanchions. The collars preferably include multiple protrusions and detents distributed at even angular increments about their internal apertures to allow a wide variety of locking positions, and thus a wide variety of possible rail orientations about a stanchion post. Additionally, the aforementioned rail holding means preferably include rail-supporting floors which maintain rails in a substantially common plane, thereby allowing each stanchion rail support to provide more even and continuous rails. Further, the rail holding means are preferably situated on the collars so that they may be aligned along a substantially linear path, thereby defining a common channel wherein a linear rail may be fit when the first and second collars are brought into abutment to engage each other.

The present invention is further directed to a stanchion rail support including two collars wherein each collar has opposing collar edges bounding an internal aperture sized to receive a rail therein and a rail holding means for supporting a rail located on each collar. Each rail holding means on each collar includes a floor for supporting at least one rail, wherein the floors of the rail holding means rest within substantially the same plane when the collars are positioned in abutting relation with their internal apertures defining a continuous passage. This allows for the mounting of rails in the same plane on the stanchion rail support to provide substantially even and continuous rails, and at the same time the collars may be rotatably positioned with respect to each other on a stanchion to allow the rail holding means (and thus the rails) to be oriented in desired directions. The rail holding means are also preferably alignable to define a continuous and substantially linear channel when the collars are positioned in abutting relation with their internal apertures defining a continuous passage. This allows a single rail or multiple rails to be simultaneously inserted in the rail holding means of both collars to provide a continuous linear rail. Additionally, the collars preferably bear collar engagement means such as the aforementioned protrusions and detents to allow users to lock the collars into a desired position.

Finally, the present invention is directed to stanchions utilizing the stanchion rail supports summarized above. Such stanchions may utilize specialized stanchion posts known to the art which are adapted for attachment to scaffolding or other particular surfaces, or they may utilize no more than freshly-cut lengths of pipe or other homemade stanchion posts, with or without a concrete ballast or other anchor means at one end.

The stanchion rail support and stanchion are intended to address the problems in the prior art apparata discussed in the Description of the Prior Art above. The stanchion rail support and stanchion are simply constructed, reliable in operation, and low in cost. Further, they are easily installable, they may be used for long periods of time (even permanently), and they may be easily removed when desired. Further features and advantages of the invention in addition to those discussed above will be apparent from the Detailed Description of the Invention following the Brief Description of the Drawings.

BRIEF DESCRIPTION OF THE DRAWINGS

The following drawings are discussed in greater depth in the Detailed Description of the Invention set out below:

FIG. 3 is a side view of the stanchion rail support of FIG. 1 shown with the upper first collar engaging the lower second collar.

FIG. 4 a top view of the stanchion rail support of FIG. 1 as it appears when the collars are engaged in the configuration of FIG. 3. Rails are illustrated in phantom.

FIG. 5 is a top view of the stanchion rail support of FIG. 1 with the collars engaged in a position offset approximately 60 degrees from the position illustrated in FIGS. 3 and 4. Rails are illustrated in phantom.

FIG. 6 is a top view of the stanchion rail support of FIG. 1 with the collars engaged in a position offset approximately 90 degrees from the position illustrated in FIGS. 3 and 4. Rails are illustrated in phantom.

FIG. 7 a top view of the stanchion rail support of FIG. 1 with the collars engaged in a position offset approximately 180 degrees from the position illustrated in FIGS. 3 and 4. Rails are illustrated in phantom.

DETAILED DESCRIPTION OF THE INVENTION

Figure 1:
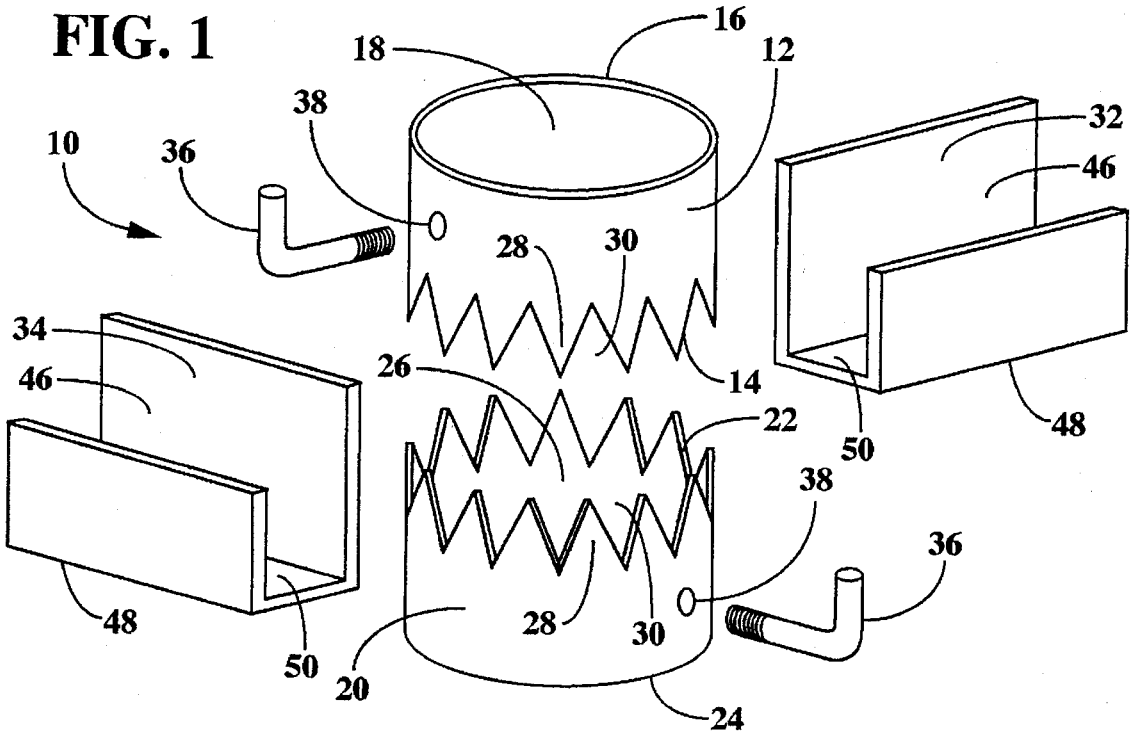
FIG. 1 is an exploded perspective view of a stanchion rail support in accordance with the present invention.

Following is a description of several preferred embodiments of the invention to further aid the reader's understanding of the claims. Throughout this description, it is understood that the same or similar features are denoted in the drawings by the same reference numerals.

Figure 2:
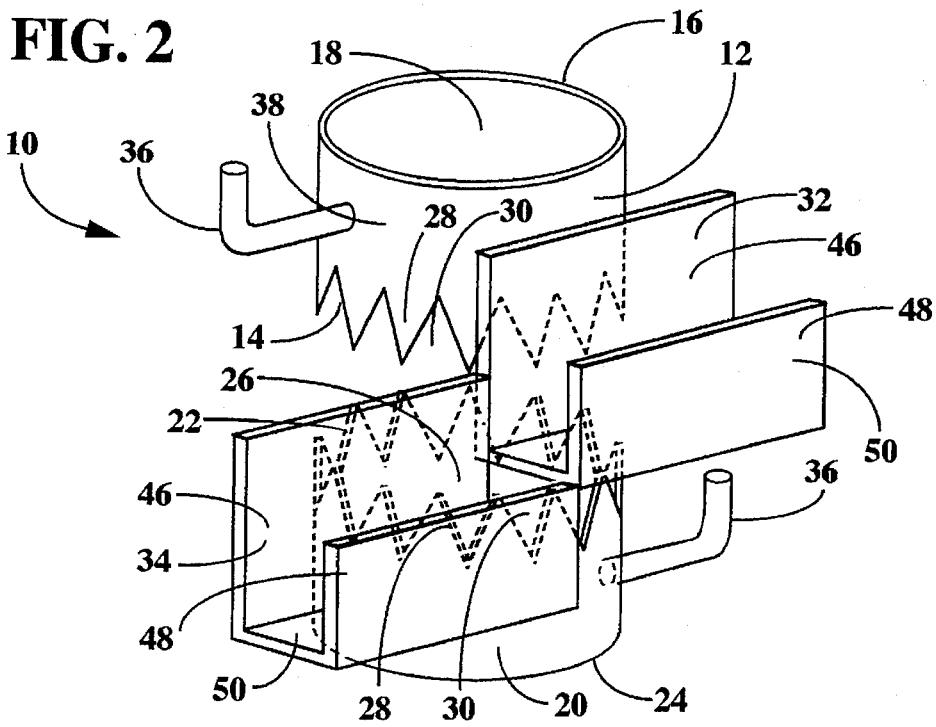
FIG. 2 is a perspective view of the stanchion rail support of FIG. 1 shown with the upper first collar disengaged from the lower second collar.

FIGS. 1–7 illustrate one preferred embodiment of a stanchion rail support 10 in accordance with the present invention. The stanchion rail support 10 includes a first collar 12 with opposing collar edges 14 and 16 bounding an internal collar aperture 18, and a second collar 20 with collar edges 22 and 24 bounding an internal collar aperture 26. The collars 12 and 20 each bear collar engagement means for preventing the collars 12 and 20 from rotating with respect to each other when they are brought into abutment with their collar apertures 18 and 26 defining a common passage. FIGS. 1–3 illustrate such collar engagement means as a series of complementary protrusions 28 and detents 30 on the collar edges 14 and 22. Each collar also bears a rail holding means for supporting at least one rail upon the respective collar. In FIGS. 1–7, these rail holding means are illustrated in the form of a first bracket 32 on the first collar 12 and a second bracket 34 on the second collar 20, each of which is sized to removably receive a rail of the desired type within (e.g., beams, rods, ropes, or straps). Finally, the first and second collars 12 and 20 each preferably bear a stanchion attachment means for supporting the collar upon a stanchion inserted within its internal collar aperture. In FIGS. 1–3, these stanchion attachment means are illustrated in the form of the thumbscrews 36, which fit within the apertures 38 in the collars 12 and 20. The thumbscrews 36 may be rotated so that they enter the collar apertures 18 and 26 and bear upon a stanchion located therein (not shown in FIGS. 1–7), thereby affixing the collars 12 and 20 to the stanchion. The collar engagement means, rail holding means, and stanchion attachment means will now be discussed in greater detail below along with other aspects of the invention.

The Collar Engagement Means

As noted above, the collars 12 and 20 each bear collar engagement means for preventing the collars 12 and 20 from rotating with respect to each other when they are brought into abutment. One preferred form of such collar engagement means is illustrated by the triangular protrusions 28 and detents 30 on the collar edges 14 and 22 of the collars 12 and 20. The protrusions 28 and detents 30 are spaced at even angular increments about the collar edges 14 and 22 so that upon rotating the collars 12 and 20 relative to each other about their common axis, any one of the protrusions 28 may be fit in any one of the detents 30. As a result, the first and second collars 12 and 20 may be separated from each other when they are mounted on a stanchion, rotated with respect to each other, and then brought together into abutment so that the protrusions 28 and detents 30 engage each other to prevent subsequent relative rotation. To further explain, if a stanchion is envisioned within the internal collar apertures 18 and 26 of the collars 12 and 20 illustrated if FIGS. 1–7, the collars 12 and 20 could rotate about the stanchion if they are disengaged as illustrated in FIGS. 1 and 2, but they would not be able to rotate about the stanchion if they are engaged as shown in FIG. 3. This allows the user of the stanchion rail support 10 to align and lock the rail holding means, e.g., the first and second brackets 32 and 34, at any desired angle consistent with the mutual engagement of the protrusions 28 and detents 30. As an example, in the embodiment of FIGS. 1–3, there are twelve protrusions 28 and twelve detents 30 spaced at equal arcs about the collar edges 14 and 22 of the first and second collars 12 and 20 so that the collars may engage each other with one collar in any one of twelve different angular orientations with respect to the other collar. These orientations are separated from each other by 30 degrees. FIG. 4 then shows the brackets 32 and 34 at a 0 degree position to form a straight railing; FIG. 5 shows the brackets 32 and 34 at a 60 degree position to form a railing with a 60 degree corner; FIG. 6 shows the brackets 32 and 34 at a 90 degree position to form a railing with a square corner; and FIG. 7 shows the brackets 32 and 34 at a 180 degree position, to form a straight railing where the rails are too long to be simultaneously accommodated within a common channel such as that shown in FIG. 4.

It is understood that the collar engagement means may be provided in various forms apart from those utilized in the preferred embodiment described above and illustrated in the Figures. Following is a description of several alternate collar engagement means.

First, in alternate embodiments, the protrusions 28 and detents 30 may be spaced at equal angular increments other than 30 degrees, these angular spaces corresponding to those which are most commonly needed at construction sites. For example, if each protrusion and detent is spaced 5 degrees apart, railings can be aligned at 0, 5, 10, 15, 20, etc. degrees as the user desires. Other common configurations that are desirable are collars wherein the protrusions 28 and detents 30 are spaced at 15 degree increments to allow railings to rest at 0, 15, 30, 45, etc. degrees, or at 45 degree increments to allow railings to rest at 0, 45, 90, 135, etc. degrees. In any case, it is desirable that the protrusions and detents allow rails to be aligned at 0, 90, 180, and 270 degrees, since railings are most commonly situated along the straight lines and square corners formed at these angles.

Second, a variety of other configurations for the protrusions 28 and detents 30 can be used apart from those configurations shown in the Figures. For example, the protrusions 28 could be in the form of teeth which instead have sinusoidal, square, sawtooth, or other profiles, or could be in the form of rodlike pins which extend downward from the collar edge 14 to insert within cylindrical detents 30 the collar edge 22. Particular configurations of the detents and protrusions may be chosen to achieve particular engagement characteristics; for example, where the protrusions 28 and detents 30 with rounded edges and/or gently sloped sides can allow the protrusions 28 on one collar to be more easily lifted, rotated, and received in an adjacent detent 30, whereas protrusions 28 and detents 30 which are deeper or which have more square corners can make it more difficult to disengage the collars. Protrusions 28 and detents 30 having a sinusoidal profile, i.e., protrusions 28 which are square or rectangular teeth with rounded edges, are particularly preferred as offering good engagement with fairly easy disengagement when the collars 12 and 20 are separated.

Third, adjacent protrusions 28 and detents 30 need not be situated precisely adjacent each other, and they may be separated by flat portions along the collar edges 14 and 22.

Fourth, either or both of the collar edges 14 and 16, or 22 and 24, can include protrusions 28 and detents 30. Depending on the form of the rail holding means (e.g., a loop rather than the open brackets 32 and 34), this can allow the collars 12 and 20 to function in the positions illustrated in FIGS. 1–7, or in an inverted position when a stanchion is inserted within their collar apertures 18 and 26.

Fifth, the protrusions 28 and detents 30 need not be situated on the collar edges 14 and 22. They can instead be provided on structures which protrude from the bodies of the collars 12 and 20, for example, on circular plates which are circumferentially mounted to the collars 12 and 20 between the collar edges 14/16 and 22/24.

The Rail Holding Means

FIGS. 1–7 illustrate rail holding means in the form of J- or U-shaped brackets 32 and 34 situated on the first and second collars 12 and 20. The first bracket 32 includes an attachment wall 40 which is attached to the first collar 12, a support wall 42 spaced from the attachment wall 40, and a floor plate 44 which maintains the attachment wall 40 and support wall 42 in a spaced relation. The first bracket 32 therefore allows a rail to be supported on the floor plate 44 between the attachment wall 40 and the support wall 42. The second bracket 34 similarly includes an attachment wall 46, a support wall 48, and a floor plate 50 which function similarly to those components in the first bracket 32.

Numerous other rail holding means apart from the brackets 32 and 34 illustrated in the Figures may be used, these rail holding means comprising essentially any structure known to the art for mounting rails to surfaces. For example, the rail holding means may be hook-like brackets (e.g., the brackets 32 and 34), loop-like brackets which encircle entire rails or portions of rails (e.g., rings or eyelets), or fasteners or fastener-receiving structures affixed to the collars 12 and 20 (e.g., threaded receptacles on the collars allowing rails to be bolted therein, or fasteners protruding from the collars to be received within receptacles in the rails). If desired, the rail holding means can include structure for firmly attaching the rails within the rail holding means, as where apertures are provided in the brackets 32 and 34 to allow fasteners to engage rails borne within. Similarly, the rail holding means can be provided in the form of clips, clamps, buckles, or similar devices which may be actuated to close about rails and affix them to the collars 12 and 20.

The rail holding means are preferably situated on the collars 12 and 20 so that when the collar engagement means (e.g., the protrusions 28 and detents 30) are engaged, the rail holding means on the collars 12 and 20 may be positioned adjacent each other in such a manner that a linear channel is defined. This is particularly illustrated in FIGS. 3 and 4, which show the alignment of brackets 32 and 34 to form a common linear channel. This allows two rails to each be separately received within an individual bracket 32 or 34, as shown in FIG. 4, or alternatively a single rail may be inserted within the brackets 32 and 34 on both collars 12 and 20 at the same time to span both collars.

Additionally, the rail holding means are preferably situated on the collars 12 and 20 so that when the collar engagement means (e.g., the protrusions 28 and detents 30) are engaged, the rail holding means both support rails within substantially the same plane. FIG. 3 illustrates this with respect to the brackets 32 and 34, wherein the floor plates 50 are substantially coplanar so that rails resting thereupon are also substantially coplanar. This feature is helpful for constructing guard rails wherein the railing is substantially smooth and continuous, thereby reducing irregularities and protruding rail surfaces that may catch on passerby.

The Stanchion Attachment Means

FIGS. 1–7 illustrate thumbscrews 36 on each collar 12 and 20 for use as stanchion attachment means for supporting each collar upon a stanchion inserted within its internal collar aperture 18 and 26. The stanchion attachment means allow the stanchion rail support 10 to be affixed to a stanchion at any desired height.

Stanchion attachment means suitable for use on the stanchion rail support 10 include structures which extend through a collar 12 and/or 20 and into the internal collar aperture 18 and/or 26 to bear upon a stanchion (e.g., the thumbscrews 36); lands or other protruding structures which rest on a stanchion to increase its diameter to a point such that a collar 12 and/or 20 cannot fit over the lands; structure on the collar 12 and/or 20 allowing the internal collar aperture to be decreased in size until the collar closes upon the stanchion (as by providing the collar with a collet-type structure and a compression ring); or other means known to the art for allowing affixation of a collar about a member resting therein.

It is understood that stanchion attachment means are not required on both collars 12 and 20. For example, in the stanchion rail support 10 illustrated in FIGS. 1–3, stanchion attachment means could only be included on the second collar 20 since it would support the first collar 12 on a stanchion. It is further understood that the stanchion attachment means are not necessarily required for the practice of the invention at all; for example, they may be omitted where the stanchion rail support 10 is to be used to attach toeboards to stanchions.

Stanchions

Figure 8:
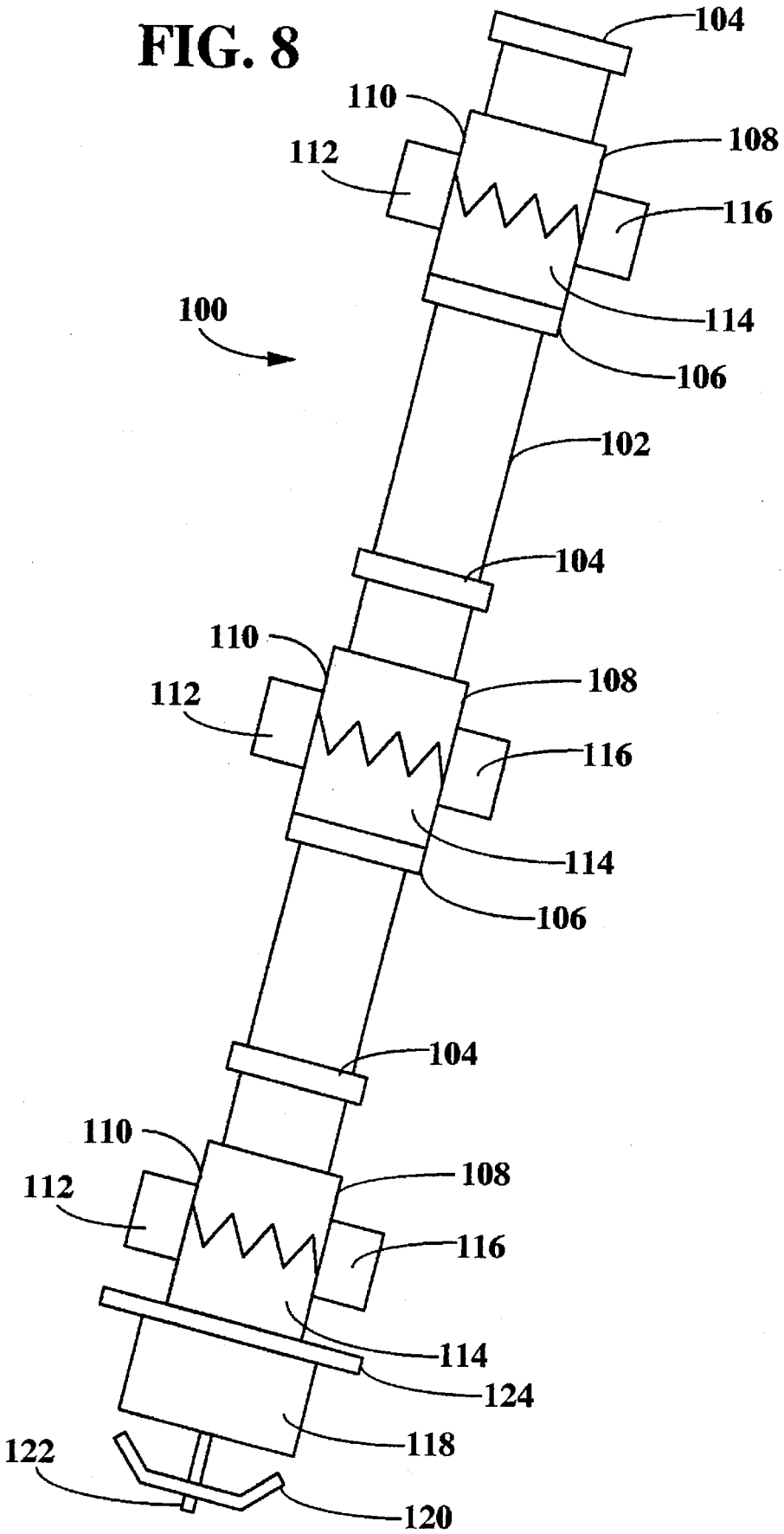
FIG. 8 is a rear elevated view of a stanchion which incorporates stanchion rail supports in accordance with the present invention.

FIG. 8 illustrates a stanchion 100 in accordance with the present invention. The stanchion 100 includes a stanchion post 102 having pairs of stops 104 and 106 along its length, and stanchion rail supports 108 resting between the paired stops 104/106. The stops 104 and 106 thereby serve as stanchion attachment means for preventing the stanchion rail supports 108 from slipping downward or off the stanchion post 102. The stanchion rail supports 108, which may take the form of any of the embodiments discussed above, include a first collar 110 with a first bracket 112, and a second collar 114 with a second bracket 116. Preferably, the stops 104 and 106 are spaced just far enough apart that the collars 110 and 114 of the stanchion rail supports 108 can be separated, rotated, and then lowered into abutment with their brackets 112 and 116 at different angular orientations.

An alternate stanchion in accordance with the present invention corresponds to the one described in the paragraph above, but wherein the second collar 114 and its associated structure are integral with the stanchion post 102. In effect, the second collar 114 itself serves as a stop 106.

The stanchion 100 also preferably includes anchor means at one end of the stanchion post 102 for anchoring the post to a surface. The particular anchor means illustrated in FIG. 4 include a male section 118 sized to be received within an aperture in a scaffolding, a removable clamping plate 120 which may be tightened against the male section by use of a screw 122, and a base plate 124 for abutment against the surface wherein the male section 118 is inserted. This base plate 124 also serves as a stop (i.e., as a stanchion attachment means) for preventing the lowermost stanchion rail support 108 from slipping downward or off the stanchion post 102. It is understood that the anchor means can instead take the form of any other anchor means known to the prior art, for example, the various anchor means illustrated in the patents noted earlier in this specification (in particular, U.S. Pat. No. 3,995,833 to McLaughlin et al.; U.S. Pat. No. 4,236,698 to Compte; U.S. Pat. No. 4,577,449 to Celli; U.S. Pat. No. 4,666,131 to Kettelkamp, Sr. et al.; U.S. Pat. No. 4,752,060 to McCluskey et al.; and U.S. Pat. No. 5,314,167 to Holloman), or alternatively ballasts, tripods, or other support bases.

OTHER ASPECTS OF THE INVENTION

It is understood that while the collars and stanchion posts are illustrated in the drawings as having a round cross-section, this round cross-section is not necessary for the invention. Essentially, the collars may have any shape which allows them to both rotate and axially slide about the length of a stanchion post. For example, collars may have polygonal shapes, such as an octagonal shape. Octagonal collars could include a single detent or protrusion on each of their eight sides, thereby allowing the collars to be rotatably engaged at 45 degree increments.

It is understood that the invention is not confined to the particular uses and construction of parts described and illustrated above, and that it additionally includes modified embodiments that come within the scope of the following claims. Further, it is understood that in these claims, means plus function clauses are intended to cover the particular structures described in this disclosure which perform their stated function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A stanchion rail support comprising:

a. a first collar including (1) an internal aperture sized to receive a stanchion post therein, (2) at least one protrusion adjacent the internal aperture, and (3) rail holding means for supporting at least one rail on the first collar, the rail holding means defining a passage wherein a rail may be placed;

b. a second collar including (1) an internal aperture sized to receive a stanchion post therein, the internal aperture being generally coaxial with the internal aperture of the first collar, (2) at least one detent adjacent the internal aperture, each detent being sized to receive one protrusion therein when the second collar is brought into abutment with the first collar, and (3) rail holding means for supporting at least one rail on the second collar, the rail holding means defining a passage wherein a rail may be placed;

wherein the first and second collars may be positioned in abutment with adjacently aligned rail holding means, the rail holding means of the first and second collars thereby defining a continuous substantially linear common passage wherein a rail may be fit.

2. The stanchion rail support of claim 1 wherein the first collar includes at least two protrusions spaced about the internal aperture.

3. The stanchion rail support of claim 2 wherein the protrusions are spaced at even angular increments about the internal aperture.

4. The stanchion rail support of claim 3 wherein the protrusions are spaced at some multiple of 5 degrees about the internal aperture.

5. The stanchion rail support of claim 3 wherein the protrusions are spaced at some multiple of 15 degrees about the internal aperture.

6. The stanchion rail support of claim 3 wherein the protrusions are spaced at some multiple of 45 degrees about the internal aperture.

7. The stanchion rail support of claim 1 wherein each rail holding means includes a floor for supporting at least one rail, and wherein the floors of the rail holding means rest within substantially the same plane.

8. The stanchion rail support of claim 1 in combination with a stanchion attachment means for supporting at least one collar on a stanchion inserted within the collar.

9. The stanchion rail support of claim 8 wherein the stanchion attachment means is provided on the collar.

10. The stanchion rail support of claim 1 in combination with a stanchion post resting within the collar apertures of the collars, the stanchion post including an anchor means at one end of the stanchion post for anchoring the stanchion post to a surface.

11. A stanchion rail support comprising two collars, each collar including:

a. opposing collar edges bounding an internal aperture sized to receive a stanchion post therein, and b. a rail holding means for supporting a rail, each rail holding means including a floor for supporting at least one rail and defining a passage wherein a rail may be inserted, each passage being oriented along a line which does not intersect the axis of the stanchion post, wherein a stanchion post may be simultaneously fit within the internal apertures of both collars and the collars may be positioned in abutting relation, thereby locating the floors of the rail holding means within substantially the same plane and also locating the rail holding means adjacently so that their passages are oriented substantially collinearly.

12. The stanchion rail support of claim 11 wherein one collar bears protrusions spaced about its internal aperture, and the other collar bears detents spaced about its internal aperture, each detent being sized to removably receive one protrusion therein when the collars are positioned in abutting relation.

13. The stanchion rail support of claim 12 wherein the protrusions are spaced at identical angular increments about the internal aperture.

14. The stanchion rail support of claim 11 in combination with a stanchion attachment means for supporting at least one collar on a stanchion inserted within the collar.

15. The stanchion rail support of claim 14 wherein the stanchion attachment means is provided on the collar.

16. The stanchion rail support of claim 11 wherein each rail holding means is defined by a generally U-shaped channel.

17. A stanchion comprising:

a. a first collar including an internal aperture and first rail holding means for supporting at least one rail, the first rail holding means defining a passage wherein a rail may be inserted;

b. a stanchion post rotatably and slidably fit within the internal aperture of the first collar, the stanchion post including (1) second rail holding means for supporting at least one rail, (2) collar engagement means for engaging portions of the first collar, these portions being spaced about the internal aperture, when the first collar is slid on the stanchion post into abutment with the collar engagement means, and (3) a first stop on the stanchion post, the first stop being spaced from the collar engagement means and being sized to prevent passage of the first collar on the stanchion post so that the first collar is restrained to slide on the stanchion post between the first stop and the collar engagement means, wherein the passage defined by the first rail holding means is oriented along a line which does not intersect the axis of the stanchion post.

18. The stanchion of claim 17 further comprising a second collar including an internal aperture wherein the stanchion post is rotatably and slidably fit, the second rail holding means and collar engagement means being located on the second collar.

19. The stanchion of claim 18 further comprising a second stop spaced from the first stop, wherein the first and second collars are located between the first and second stops.

20. The stanchion of claim 17 wherein the first and second rail holding means each include a floor whereupon a rail may be supported, the floors being substantially coplanar, and further wherein the first and second rail holding means may be adjacently positioned to define a common channel wherein a substantially linear rail may be fit.

* * * * *